US010406665B2

(12) United States Patent
Dittrich et al.

(10) Patent No.: US 10,406,665 B2
(45) Date of Patent: Sep. 10, 2019

(54) SETTING DEVICE HAVING A TEMPERATURE SENSOR

(71) Applicant: Hilti Aktiengesellschaft, Schaan (LI)

(72) Inventors: Tilo Dittrich, Feldkirch (AT); Norbert Heeb, Buchs (CH); Peter Stauss-Reiner, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 484 days.

(21) Appl. No.: 15/038,083

(22) PCT Filed: Nov. 25, 2014

(86) PCT No.: PCT/EP2014/075466
§ 371 (c)(1),
(2) Date: May 20, 2016

(87) PCT Pub. No.: WO2015/078834
PCT Pub. Date: Jun. 4, 2015

(65) Prior Publication Data

US 2016/0303724 A1 Oct. 20, 2016

(30) Foreign Application Priority Data

Nov. 26, 2013 (EP) ..... 13194420

(51) Int. Cl.
*B25C 1/08* (2006.01)
*B25F 5/00* (2006.01)

(52) U.S. Cl.
CPC . *B25C 1/08* (2013.01); *B25F 5/00* (2013.01)

(58) Field of Classification Search
CPC .. B25C 1/08; B25C 1/143; B25F 5/00; B25D 2217/0084; B25D 2250/121
(Continued)

(56) References Cited

U.S. PATENT DOCUMENTS 4,075,850 A * 2/1978 Nakazato ..... B25C 1/08 173/200
6,321,968 B1 * 11/2001 Remerowski ..... B25C 1/18 227/10
(Continued)

FOREIGN PATENT DOCUMENTS

EP 2 368 669 A2 9/2011
EP 2 656 973 A2 10/2013
(Continued)

OTHER PUBLICATIONS

European Patent Office, European Search Report in European Patent Application No. 13194420.9, dated Jun. 11, 2014.
(Continued)

*Primary Examiner* — Robert F Long
(74) *Attorney, Agent, or Firm* — Leydig, Voit & Mayer

(57) ABSTRACT

A setting device is provided, comprising a housing, a combustion chamber having an ignition apparatus, a storage container having a container wall for storing fuel, a dosing apparatus for adding a specified volume of fuel to the combustion chamber, an apparatus, such as a firing pin, for inserting a setting element into a setting object, wherein a setting force can be applied to the apparatus as a result of the pressure of combustion gas such that the apparatus is operable by combustion force, a control unit, and a temperature sensor for detecting the temperature of the fuel in the storage container. The setting device is designed such that, while the storage container is connected to the setting device, the temperature sensor mechanically contacts an outer surface of the container wall, for indirect detection of the temperature of the fuel.

17 Claims, 2 Drawing Sheets

Figure 1:
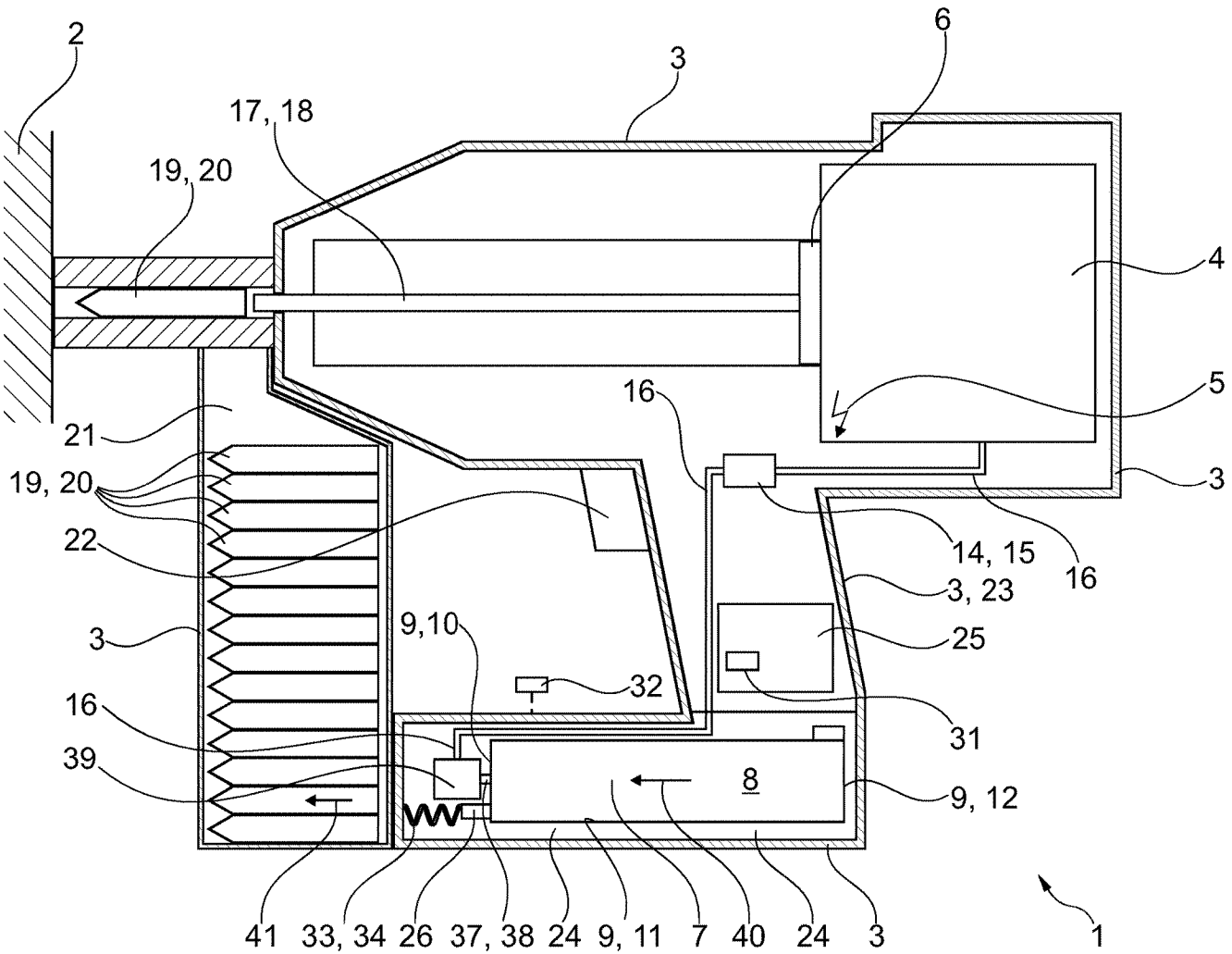

(58) Field of Classification Search
USPC ..... 227/2, 10, 130; 173/90; 91/169, 217, 91/423, 442, 469
See application file for complete search history.

(56) References Cited

U.S. PATENT DOCUMENTS

| | | | | |
|---|---|---|---|---|
| 6,722,550 | B1 * | 4/2004 | Ricordi | B25C 1/08 123/46 SC |
| 7,438,207 | B2 * | 10/2008 | Wu | B25C 1/047 227/130 |
| 8,721,175 | B2 | 5/2014 | Cordeiro et al. | |
| 2006/0225675 | A1 * | 10/2006 | Nishikawa | B25C 1/08 123/46 H |
| 2010/0327039 | A1 * | 12/2010 | Adams | B25C 1/08 227/9 |
| 2011/0180581 | A1 * | 7/2011 | Liang | B25C 1/041 227/8 |
| 2011/0303724 | A1 | 12/2011 | Groer et al. | |
| 2012/0312857 | A1 * | 12/2012 | Grazioli | B25C 1/08 227/10 |
| 2013/0269961 | A1 * | 10/2013 | Lim | B25F 5/001 173/1 |
| 2013/0288191 | A1 | 10/2013 | Gerold et al. | |
| 2016/0368127 | A1 * | 12/2016 | Franz | B25C 1/04 |

FOREIGN PATENT DOCUMENTS

| | | | |
|---|---|---|---|
| JP | 2004-061001 | A | 2/2004 |
| JP | 2004-333120 | A | 11/2004 |
| TW | 201201977 | A | 1/2012 |
| TW | 201235164 | A | 9/2012 |
| TW | 201304913 | A | 2/2013 |
| WO | WO 2005/011923 | A1 | 2/2005 |

OTHER PUBLICATIONS

International Bureau, International Search Report in International Patent Application No. PCT/EP2014/075466, dated Feb. 25, 2015.

* cited by examiner

SETTING DEVICE HAVING A TEMPERATURE SENSOR

CROSS-REFERENCE TO RELATED APPLICATIONS

This patent application is the U.S. National Stage of International Patent Application No. PCT/EP2014/075466, filed Nov. 25, 2014, which claims the benefit of European Patent Application No. 13194420.9, filed Nov. 26, 2013, which are each incorporated by reference.

The present invention relates to a setting device according to the preamble of claim 1 and to a method according to the preamble of claim 11 for setting a setting bolt in a setting object.

BACKGROUND OF THE INVENTION

Setting elements such as nails or bolts are inserted into a setting object in order to be able to fasten a fastening part on the setting object by means of the setting elements. The setting elements can also be additionally inserted into the fastening part, e.g. a wooden lath, as an additional setting object in order to fasten the fastening part on the other setting object, e.g. a wooden beam.

Setting devices operated by combustion force have a combustion chamber with an ignition apparatus. A gaseous fuel is normally introduced into the combustion chamber so that a mixture of air and fuel is present inside the combustion chamber. The ratio of the quantities of fuel and oxygen inside the combustion chamber must be coordinated for optimal combustion. Various parameters must be taken into account for this purpose and it is necessary to introduce a predetermined quantity of fuel into the combustion chamber for a combustion process. To introduce fuel into the combustion chamber, combustion force-operated setting devices have a solenoid valve as a metering apparatus. A control unit controls the opening time of the metering apparatus, the solenoid valve for example, so that the predetermined quantity of fuel is introduced thereby into the combustion chamber. The fuel is stored in a storage container on the setting device. The storage container, a gas bottle or a gas cartridge for example, is replaced after consumption of the fuel in the storage container, i.e. the storage container is a consumable that must be continually exchanged or replaced by the user of the setting device. The opening time of the metering apparatus is controlled and/or regulated by a control unit on the basis of the temperature of the fuel. This requires detecting the temperature of the fuel in the storage container by means of a temperature sensor.

A combustion force-operated setting device is known from EP 2 368 669 A2. The setting device comprises a combustion chamber in order to introduce setting elements into a setting object by means of combustion force. The temperature of the combustion chamber is detected by using a temperature sensor. The temperature of the combustion chamber and the temperature of the fuel are transmitted to a management module and the opening time of a metering apparatus is controlled by the management module.

The problem addressed by the present invention is that of providing a setting device and a method for setting a setting bolt in a setting object, in which method the temperature of the fuel in the storage container can be detected with a low technical effort in order to precisely add a predetermined material quantity of fuel to the combustion chamber.

BRIEF SUMMARY OF THE INVENTION

This problem is solved with a setting device comprising: a housing; a combustion chamber having an ignition apparatus; preferably a storage container having a container wall, for storing fuel; a metering apparatus for feeding a predetermined quantity of fuel to the combustion chamber; an apparatus such as a striking pin for introducing a setting element into a setting object, and a setting force can be applied to the apparatus due to the pressure of gas in the combustion chamber such that the apparatus can be operated with combustion force; a control unit; a temperature sensor for detecting the temperature of the fuel in the storage container, wherein the setting device is designed such that, if a storage container is connected to the setting device, the temperature sensor for detecting the temperature of the fuel in the storage container is in mechanical contact with an outer surface of the container wall in order to detect the fuel temperature indirectly. Due to the detection of the temperature of the outer surface, i.e. an outer side of the container wall of the storage container, the temperature of the fuel inside the storage container can be indirectly determined particularly precisely. The container wall consists of a material, particularly metal, having a good thermal conductivity, and therefore the temperature at the outer surface of the container wall corresponds substantially to the temperature of the fuel inside the storage container.

In an additional embodiment, the setting device comprises an elastic element, particularly a spring, and the elastic element is operatively connected mechanically to the temperature sensor, and the temperature sensor is movably mounted on the remaining part of the setting tool such that, on the storage container connected to the setting device, the temperature sensor is pressed by a force exerted by the elastic element on the temperature sensor against the outer surface of the container wall, more particularly a top wall or a bottom wall of the storage container. Tolerances, particularly due to temperature fluctuations, can occur between the arrangement of the temperature sensor on the remainder of the setting device and the outer surface of the container wall when there is a connection between the storage container and the remainder of the setting device. The elastic element and the elastic deformability of the elastic element ensure that there is always a sufficient contact between the temperature sensor and the outer surface of the container wall. A thermal conduction paste can also be arranged between the temperature sensor and the outer surface of the container wall in order to improve the heat transmission from the outer surface of the container wall to the temperature sensor.

In a supplemental embodiment, the elastic element comprises a first, immovable end portion connected to the remainder of the setting device and a second, movable end portion, and in particular the temperature sensor is mechanically connected to the second, movable end portion of the elastic element.

In a supplemental variant, the temperature sensor is movable, in particular movably mounted, on the second end portion of the elastic element due to the mechanical connection to the elastic element. The temperature sensor is connected to the second, movable end portion of the elastic element in such a manner that the second, movable end portion of the elastic element and the temperature sensor carry out a movement together in a movement direction.

The storage container expediently comprises as its container wall a top wall, a bottom wall and at least one side wall, and a withdrawal device is formed on the top wall for conducting the fuel out of the storage container. The storage container generally has labeling or painting only on the side wall, so that the outer surface of the storage container on the bottom wall and/or the side wall is formed by a metallic surface if the container wall is made from metal. If the temperature sensor contacts the metal outer surface of the top wall or the bottom wall, this ensures a particularly good heat transfer from the storage container to the temperature sensor.

In a supplementary embodiment for a storage container connected to the setting device, the temperature sensor for detecting the temperature of the fuel in the storage container is in mechanical contact with the outer surface of the top wall or bottom wall in order to indirectly detect the fuel temperature.

In an additional embodiment, the setting device comprises a receiving device for fluid-tight connection of the interior of the storage container to the metering apparatus. The receiving device is connected to a fuel line such that the fuel can be conducted thereby from the receiving device to the metering apparatus and into the combustion chamber.

In an additional embodiment with a storage container connected to the setting device, the withdrawal device on the storage container is mechanically and fluid-conductively connected to the receiving device on the setting device. The withdrawal device on the storage container additionally comprises a valve and, due to a mechanical operative connection between the receiving device and the valve of the withdrawal device, the valve can be opened or is openable when the storage container is being connected to the setting device and the fuel can be conducted or is conductable to the receiving device by a withdrawal tube of the withdrawal device.

In a supplemental embodiment, the storage container can be moved in a connecting direction toward the receiving device in order to connect the withdrawal device on the storage container to the receiving device, and due to the geometry of the receiving device and preferably due to the geometry of the withdrawal device, the connecting direction is aligned substantially parallel to the movement direction of the elastic element and/or substantially parallel to an imaginary straight line through the first and second end portions of the elastic element. The connecting direction is substantially parallel to the movement direction of the elastic element and/or the movement direction of the temperature sensor, i.e. the connecting direction has a deviation of less than 30°, 20°, 10° or 5° from the movement direction. In an analogous manner, the imaginary straight line is oriented with a deviation of less than 30°, 20°, 10° or 5° from the connecting direction.

In a supplementary embodiment, a method described in the present protective rights application can be performed with the setting device and/or the fuel is stored in a liquid or gaseous aggregate state in the storage container and/or the setting element is formed as a nail or a bolt and/or the setting device comprises a magazine for storing a plurality of setting elements and/or the setting device comprises a control unit and/or the setting device comprises a temperature sensor for detecting the temperature of the surroundings at the setting device and/or the setting device comprises a pressure sensor for detecting the pressure of the fuel in the storage container and/or the setting device comprises a pressure sensor for detecting the pressure of the surroundings of the setting device and/or the metering apparatus can be controlled and/or regulated by the control unit, preferably via the opening time of the metering apparatus, in particular depending on the temperature of the fuel in the fuel storage container and preferably depending on the temperature of the surroundings and preferably depending on the pressure of the fuel in the storage container and preferably depending on the pressure of the surroundings, and/or the combustion chamber is delimited by a movable piston and the setting force can be applied to the apparatus by using the piston, and/or the temperature sensor for detecting the temperature of the fuel in the storage container is constructed from two materials having different thermal conductivity, and the material having the higher thermal conductivity, e.g. a thermal conductivity larger by a factor of 2, 5 or 10, is arranged facing the storage container on a first part of the temperature sensor, in particular between a measuring element of the temperature sensor and the outer surface of the container wall of the storage container, and the material having the lower thermal conductivity is arranged facing away from the storage container on a second part of the temperature sensor, in particular between the measuring element and the elastic element, and/or the setting device has a storage container compartment and preferably the extent of the storage container compartment is greater in the connecting direction than perpendicular to the connecting direction. Due to the differing thermal conductivity of the first and second parts of the temperature sensor, the first part of the temperature sensor, which has the measuring element, adapts particularly quickly to the temperature of the outer surface of the container wall, and due to the low thermal conductivity of the second part of the temperature sensor, only a very small quantity of heat is conducted away from the first part to the second part, i.e. the remainder of the setting device, even if there is a large difference between the temperature of the fuel in the storage container or the temperature of the outer surface of the container wall and the temperature of the surroundings at the setting device. The extent of the storage container compartment in the connecting direction is preferably larger by a factor of 1.5, 2, 3, 4 or 5 than the extent perpendicular to the change in direction.

Method according to the invention for setting a setting element in a setting object, in particular with a setting device described in the present protective rights application, comprising the steps: setting the setting element in the setting object, e.g. a concrete surface, in which method a fuel is ignited in the combustion chamber, the temperature and pressure of the gas in the combustion chamber are increased by the combustion process of the fuel in the combustion chamber, and a setting force is applied indirectly or directly by the gas in the combustion chamber to an apparatus, e.g. a striking pin for introducing a setting element into a setting object, and this setting force is transmitted by the apparatus to the setting element such that the setting element is introduced into the setting object by this setting force; the temperature of the fuel in a storage container is detected with a temperature sensor; a predetermined material quantity of fuel is introduced into the combustion chamber from the storage container for the fuel, and the feeding of the material quantity is controlled and/or regulated by controlling and/or regulating a metering apparatus, in particular the opening time of the metering apparatus, depending on the temperature of the fuel in the storage container, wherein the temperature of the fuel in the storage container is indirectly detected by detecting the temperature of the outer surface of the container wall of the storage container.

In an additional configuration, during the detection of the temperature of the fuel, the temperature sensor is brought into mechanical contact with the outer surface of the container wall of the storage container, and/or the temperature sensor is in contact with the outer surface of the container wall of the storage container.

In an additional embodiment, the temperature sensor for directly detecting the temperature of the fuel in the storage container is an optical sensor, in particular a pyrometer or a thermal imaging camera, so that the temperature of the outer surface of the container wall of the storage container is detected in a contact-free or noncontact manner.

In an additional embodiment, the temperature sensor is pressed by an elastic element, in particular a spring such as a compression spring, against the outer surface of the container wall of the storage container, so that a pressure force exists between the temperature sensor and the outer surface.

In a supplementary variant, the temperature sensor is brought into mechanical contact with the outer surface of the container wall of the storage container during mechanical and fluid-conductive connecting of a withdrawal device on the storage container to a receiving device on the setting device.

In a supplementary configuration, the storage container is moved in a connecting direction relative to the receiving apparatus on the setting device during mechanical and fluid-conductive connecting of the withdrawal device on the storage container to the receiving device, and simultaneously the elastic element, in particular the second, movable end portion of the elastic element, is moved substantially parallel to the connecting direction and/or the temperature sensor is simultaneously moved substantially parallel to the connecting direction.

In an additional embodiment, the measuring element is an NTC thermistor or a PTC thermistor.

An embodiment of the invention will be described below in detail with reference to the appended drawings. Therein:

BRIEF DESCRIPTION OF THE SEVERAL VIEWS OF THE DRAWING(S)

Figure 2:
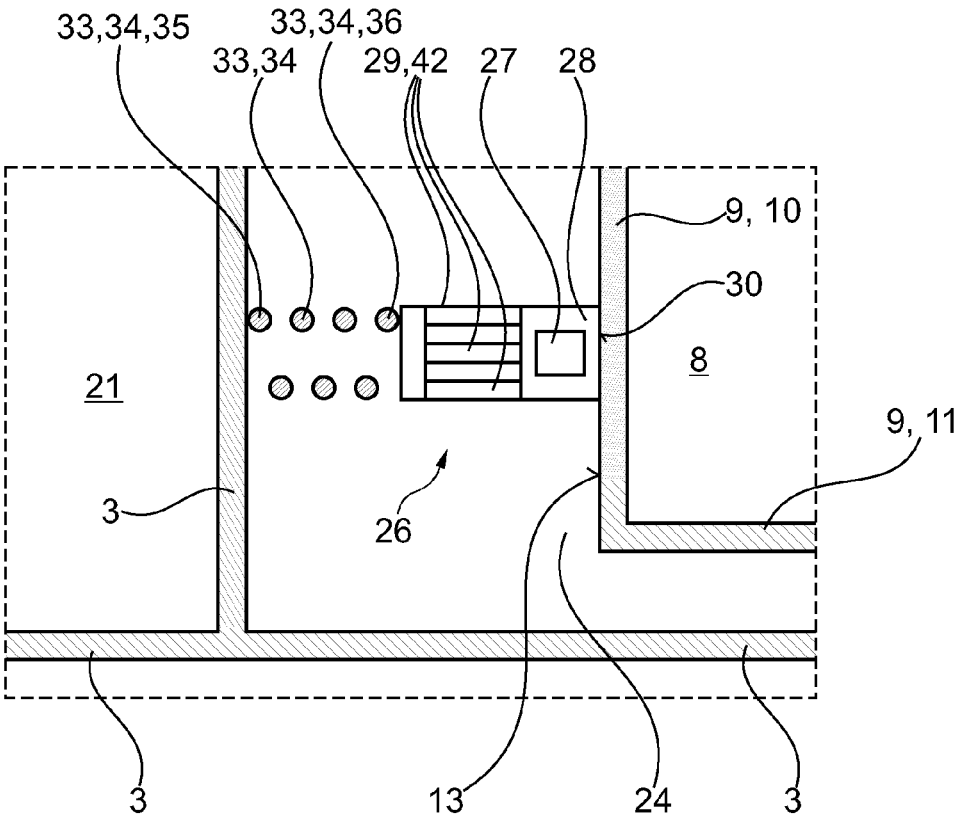

FIG. 1 shows a considerably simplified longitudinal section of a setting device, and FIG. 2 shows a partial longitudinal section of the setting device according to FIG. 1 in the area of a temperature sensor for a fuel in a storage container.

DETAILED DESCRIPTION OF THE INVENTION

A setting device 1, illustrated in FIG. 1 and operated by combustion force, is used for introducing or pounding setting elements 19 such as nails 20 or bolts into a setting object 2 such as a concrete surface or a wooden lath. The setting device 1 comprises a housing 3 made of metal and/or plastic. Gaseous or liquid fuel from a storage container 7 can be introduced by a fuel line 16 into a combustion chamber 4 having an ignition apparatus 5. When a mixture of air or oxygen and fuel is ignited in the combustion chamber 4, the temperature and therefore the pressure of the gas in the combustion chamber 4 are rapidly increased such that thereby the increased pressure of the gas in the combustion chamber 4 applies a setting force to a piston 6. This setting force is transmitted to the nail 20 by means of an apparatus 17, namely a striking pin 18, for introducing the setting element 19. A plurality of nails 20 are stored inside a magazine 21 and after one nail has 20 been driven in, another nail 20 can be automatically conveyed to the region to the left of the striking pin 18 by means of an automatic feeding mechanism (not shown). This is accomplished independently and automatically by pressing a trigger 22 on a handle 23. The trigger 22 is connected by means of an electrical control line, not shown, to a control unit 25. The ignition apparatus 5 is also connected by an electrical control line, not shown, to the control unit 25, which controls the activation of the ignition apparatus 5. An opening valve, not shown, and a fan are also arranged on the combustion chamber 4 in order to remove the combustion gases from the combustion chamber 4 after ignition and the combustion process inside the combustion chamber 4. In embodiments that are not shown, there is no fan arranged on the combustion chamber, but instead the combustion chamber ordinarily collapses after a setting process.

The storage container 7 is arranged inside a storage container compartment 24 delimited by the housing 3. The storage container 7 is designed as a gas bottle or gas cartridge and constitutes a consumable, i.e. the storage container 7 is removed by the user of the setting device 1 after consumption of the fuel therein and replaced with a new storage container 7. The storage container 7 has a container wall 9 made of metal, for example aluminum or steel, having a top wall 10, a side wall 11 and a bottom wall 12. Painting or labeling is applied to the side wall 11, and an external surface of the container wall 9 on the top wall 10 and the bottom wall 12 does not have any painting or labeling, so that the metal of the container wall 9 is directly present at the outer surface 13. The container wall 9 delimits an interior chamber 8 of the storage container 7 for receiving the liquid fuel. The fuel is arranged inside the storage container under pressure, so that the fuel is in a liquid aggregate state due to the pressure. For mechanical and fluid-conductive connection of the storage container 7 to the setting device 1, the storage container 7 is moved in a connecting direction 40 with the top wall 10 facing a receiving device 39 on the setting device 1. A withdrawal device 37 having a withdrawal tube 38 and a valve, not shown, is present on the storage container 7. The withdrawal tube 38 is to be introduced into the receiving device 39 such that there is a fluid-conductive connection between the withdrawal tube 38 and the receiving device 39. Due to a mechanical operative connection between the receiving device 39 and the valve, not shown, of the withdrawal device 37, the valve is opened after the fluid-conductive connection of the withdrawal tube 38 to the receiving device 39, so that thereby fuel is conducted from the interior 8 of the storage container 7 through the receiving device 39 and through a fuel line 16 to a metering device 14, namely a solenoid valve 15 or a piezoelectric valve, and then can be conducted further into the combustion chamber 4 through the fuel 16 line if a solenoid 15 valve is opened.

The setting device 1 further comprises a temperature sensor 31 for detecting the temperature of the surroundings at the setting device 1 or the temperature of the setting device 1, as well as a pressure sensor 32 for detecting the pressure of the fuel in the storage container 7. Differing from this, the setting device 31 can also be constructed without the pressure sensor 32. The pressure sensor 32 is fluid-conductively connected to the fuel line 16, so that the pressure sensor 32 can detect the pressure of the fuel inside the storage container 7 if there is a fluid-conductive connection between the interior 8 of the storage container 7 and the fuel line 16.

The setting device 1 further comprises a temperature sensor 26 for detecting the temperature of the fuel inside the storage container 7. The sensors 26, 31 and 32 are also connected by means of control lines, not shown, to the control unit 25, so that the data from the sensors 26, 31 and 32 can be conducted thereby to the control unit 25. The temperature sensor 26 is mounted on an elastic element 33 designed as a spring 34. The spring 34 is fixedly connected at a first, nonmovable end portion 35 to the housing 3 and is connected at a second, movable end portion 36 to the temperature sensor 26. The temperature sensor 26 is constructed from a first part 28, which faces the storage container 7, and a second part 29, which faces away from the storage container 7. A measuring element 27 of the temperature sensor 26 is arranged inside the first part 28 of the temperature sensor 26. Surrounding the measuring element 27 with the first part 28 is necessary in order to protect the measuring element 27 from mechanical damage. The second part 29 of the temperature sensor 26 is constructed from a plurality of strips 42. The thermal conductivity of the first part 28 of the temperature sensor 26 is substantially higher than the thermal conductivity of the second part 29 of the temperature sensor 26. For this purpose, the first part 28 is constructed of copper for example, and the second part 29 of plastic. There is always a mechanical contact with the metallic outer surface 13 of the container wall 9, namely the top wall 10, at the contact surface 30 of the first part 28 of the temperature sensor 29.

The geometry of the elastic element 33 and the temperature sensor 26, as well as that of the storage container 7, are designed such that when the storage container 7 is being connected to the setting device 1, i.e. the receiving device 39 is being connected to the withdrawal device 37, a contact between the temperature sensor 26, i.e. the contact surface 30, and the outer surface 13 of the container wall 9 is established even before the complete connection. For connecting the storage container 7 to the setting device 1, the storage container 7 must be moved in the connecting direction 40 toward the receiving device 39 such that an elastic deformation of the elastic element 33 occurs after contact between the contact surface 30 of the temperature sensor 26 and the outer surface 13 of the container wall 9 and thereby, after the complete connection of the setting device 1 to the storage container 7, the contact surface 30 of the temperature sensor 26 is constantly subjected to a pressure force between the contact surface 30 and the outer surface 13 due to the pressure force applied to the temperature sensor 26 by the elastic element 33. A movement direction 41 of the temperature sensor 26 and the movement direction 41 of the second movable end 36 portion of the elastic element 33 are substantially parallel to the connecting direction 40.

The temperature of the fuel inside the storage container 7 detected by the temperature sensor 26 is evaluated by the control unit 25, and the opening time of the solenoid valve 15 is controlled and/or regulated depending on the temperature of the fuel inside the storage container 7 as detected by the temperature sensor 26, the temperature of the surroundings, which is detected by the temperature sensor 31, and the pressure of the fuel inside the storage container 7, which is detected by the pressure sensor 32.

Considered as a whole, substantial advantages are related to the setting device 1 according to the invention. The inexpensive temperature sensor 26 indirectly detects the temperature of the fuel inside the storage container 7 in a particularly simple manner by detecting the temperature of the outer surface 13 of the container wall 9. Due to the elastic element 33, there is a constant mechanical contact between the temperature sensor 26 and the outer surface 13. Thereby a sufficiently precise detection of the temperature of the fuel inside the storage container 7 is advantageously guaranteed, with a low technical effort, i.e. an economical production of the setting device 1.

The invention claimed is:

1. A setting device comprising a housing, a combustion chamber having an ignition apparatus, a storage container for containing fuel, the storage container having a container wall having an outer surface, a metering apparatus for feeding a predetermined quantity of the fuel to the combustion chamber, an apparatus for introducing a setting element into a setting object, wherein a setting force can be applied to the apparatus due to pressure of ignited fuel in the combustion chamber such that the apparatus can be operated by combustion force, a control unit, a temperature sensor for detecting temperature of the fuel inside the storage container, and, an elastic element operatively connected mechanically to the temperature sensor, and the temperature sensor is movably mounted on the setting tool such that the temperature sensor is pressed by a force exerted by the elastic element on the temperature sensor against the outer surface of the container wall;

wherein, when the storage container is connected to the setting device, the temperature sensor is in mechanical contact with the outer surface of the container wall to indirectly detect the fuel temperature.

2. The setting device according to claim 1, wherein the elastic element has a first, immovable end portion connected to the housing, and a second, movable end portion mechanically connected to the temperature sensor.

3. The setting device according to claim 1, wherein the storage container comprises a top wall, and the setting device further comprises a withdrawal device on the top wall for conducting the fuel out of the storage container.

4. The setting device according to claim 3, wherein the storage container comprises a bottom wall, and the temperature sensor is in mechanical contact with the outer surface of the container top wall or the container bottom wall to indirectly detect the fuel temperature.

5. The setting device according to claim 3, wherein the storage container has an interior, and the setting device comprises a receiving device for fluid-tight connection of the interior of the storage container to the metering apparatus.

6. The setting device according to claim 5, wherein when the storage container is connected to the setting device, the withdrawal device on the storage container is connected mechanically and fluid-conductively to the receiving device on the setting device.

7. The setting device according to claim 5, wherein the elastic element has a first, immovable end portion connected to the setting device, and a second moveable end portion mechanically connected to the temperature sensor, and in order to connect the withdrawal device on the storage container to the receiving device, the storage container is moveable in a connecting direction toward the receiving device and the connecting direction is aligned substantially parallel to the movement direction of the elastic element and/or substantially parallel to an imaginary straight line through the first and second end portions of the elastic element.

8. The setting device according to claim 1, wherein the fuel is stored in a liquid or gaseous aggregate state in the storage container and/or the setting element is a nail or a bolt and/or the setting device comprises a magazine for storing a plurality of setting elements and/or the setting device comprises a control unit and/or the setting device comprises a temperature sensor for detecting temperature of surroundings at the setting device and/or the setting device comprises a pressure sensor for detecting pressure of the fuel inside the storage container and/or the metering apparatus can be controlled and/or regulated by a control unit and/or the combustion chamber is delimited by a movable piston and the setting force is applied to the apparatus using the piston and/or the temperature sensor for detecting the temperature of the fuel in the storage container comprises first and second materials having different thermal conductivity, and a first material having the higher thermal conductivity is arranged facing the storage container on a first part of the temperature sensor and a second material having the lower thermal conductivity is arranged facing away from the storage container on a second part of the temperature sensor and/or the setting device has a storage container compartment for the storage container.

9. A method for setting a setting element into a setting object using a setting device, the setting device comprising a housing; a combustion chamber having an ignition apparatus; a storage container for containing fuel, the storage container having a container wall having an outer surface; a metering apparatus for feeding a predetermined quantity of the fuel to the combustion chamber; an apparatus for introducing a setting element into a setting object, wherein a setting force can be applied to the apparatus due to pressure of ignited fuel in the combustion chamber such that the apparatus can be operated by combustion force, a control unit; and a temperature sensor for detecting temperature of the fuel inside the storage container; wherein, when the storage container is connected to the setting device, the temperature sensor is in mechanical contact with the outer surface of the container wall to indirectly detect the fuel temperature;

the method comprising setting the setting element on the setting object; igniting the fuel in the combustion chamber, wherein a temperature and a pressure of gas in the combustion chamber are increased by a combustion process of the fuel in the combustion chamber, and applying the setting force to the apparatus, such that the setting force is transmitted by the apparatus to the setting element, and setting the setting element into the setting object, the method including pressing the temperature sensor by an elastic element against the outer surface of the container wall of the storage container and indirectly detecting the temperature of the fuel in the storage container by detecting the temperature of the outer surface of the container wall of the storage container.

10. The method according to claim 9, including bringing the temperature sensor into mechanical contact with the outer surface of the container wall of the storage container and/or contacting the outer surface of the container wall of the storage container with the temperature sensor during detection of the temperature.

11. The method according to claim 9, including mechanically contacting the temperature with the outer surface of the container wall of the storage container during mechanical and fluid-conductive connecting of a withdrawal device on the storage container to a receiving device on the setting device.

12. The method according to claim 9, including moving the storage container in a connecting direction relative to the receiving device on the setting device and simultaneously moving the elastic element substantially parallel to the connecting direction and/or simultaneously moving the temperature sensor substantially parallel to the connecting direction, during mechanical and fluid-conductive connecting of the withdrawal device on the storage container to the receiving device.

13. The setting device of claim 1, wherein the apparatus for introducing the setting element into the setting object comprises a striking pin.

14. The setting device according to claim 3, wherein the elastic element has a first, immovable end portion connected to the setting device, and a second, movable end portion mechanically connected to the temperature sensor.

15. The setting device according to claim 2, wherein the temperature sensor is movable with the second end portion of the elastic element.

16. The setting device according to claim 15, wherein the storage container comprises a top wall, and the setting device further comprises a withdrawal device on the top wall for conducting the fuel out of the storage container.

17. The setting device according to claim 2, wherein the storage container comprises a top wall, and the setting device further comprises a withdrawal device on the top wall for conducting the fuel out of the storage container.

* * * * *